US005341618A

United States Patent [19]

Schaaf et al.

[11] Patent Number: 5,341,618

[45] Date of Patent: Aug. 30, 1994

[54] NON-RECTANGULAR BLOCK AND WALL

[76] Inventors: Cecil F. Schaaf, 3015 Palmer Rd., Standish, Mich. 48658; Craig R. Schaaf, 741 Crawford St., Flint, Mich. 48507

[21] Appl. No.: 848,379

[22] Filed: Mar. 9, 1992

[51] Int. Cl.[5] ..... E04B 2/00

[52] U.S. Cl. ..... 52/608; 52/604; 52/605; 52/609

[58] Field of Search ..... 52/608, 609, 610, 611, 52/604, 605, 606, 607, 144, 596; 47/33; 404/42; 405/262, 284

[56] References Cited

U.S. PATENT DOCUMENTS

| | | | |
|---|---|---|---|
| 212,243 | 2/1879 | Luke et al. | 52/604 |
| 245,340 | 8/1887 | Johnson . | |
| 772,476 | 10/1904 | Podmore . | |
| 776,441 | 11/1904 | Veyon . | |
| 1,234,990 | 7/1917 | Wilson . | |
| 1,262,308 | 4/1918 | Colt . | |
| 1,338,468 | 4/1920 | Tsanoff . | |
| 1,411,005 | 3/1922 | Dula . | |
| 1,458,551 | 3/1923 | Seat . | |
| 1,700,542 | 9/1926 | O'Donnell . | |
| 2,021,133 | 11/1935 | Manson | 52/604 |
| 2,185,497 | 1/1940 | Cilento et al. . | |
| 2,550,945 | 5/1951 | Steinhage et al. | 52/609 |
| 2,951,001 | 8/1960 | Rubenstein . | |
| 4,335,549 | 6/1982 | Dean, Jr. . | |
| 4,590,726 | 5/1986 | Salazar . | |
| 4,631,885 | 12/1986 | Iannarelli . | |
| 4,738,059 | 4/1988 | Dean, Jr. | 52/596 |

FOREIGN PATENT DOCUMENTS

| | | | |
|---|---|---|---|
| 2213433 | 10/1973 | Fed. Rep. of Germany | 52/611 |
| 2527746 | 1/1977 | Fed. Rep. of Germany | 52/604 |
| 10586 | 4/1897 | United Kingdom | 52/609 |

*Primary Examiner*—Carl D. Friedman
*Assistant Examiner*—Christopher T. Kent
*Attorney, Agent, or Firm*—Robert L. McKellar

[57] ABSTRACT

This invention deals with certain specific building blocks that can be used to build stable retaining walls and stable decorative walls having novel features such as convenience in manufacturing, handling, and using.

2 Claims, 5 Drawing Sheets

Fig. 9
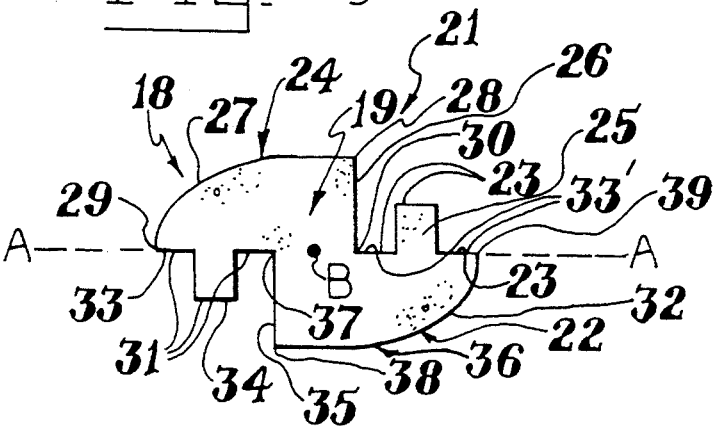
Fig. 10
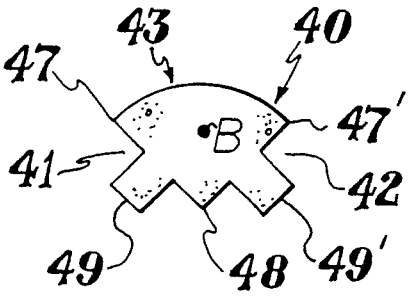
Fig. 9A
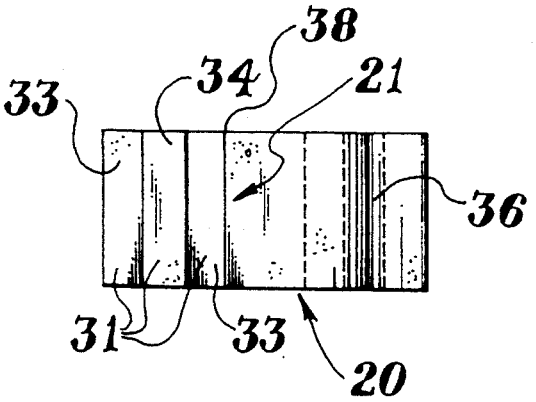
Fig. 10A
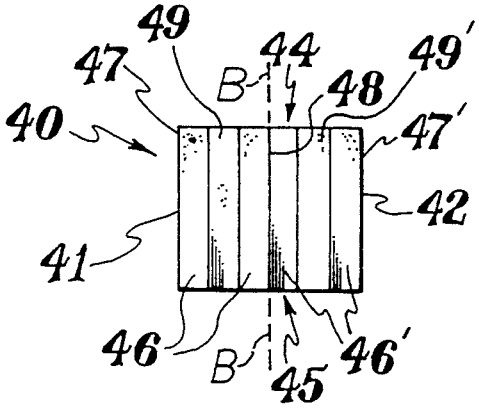
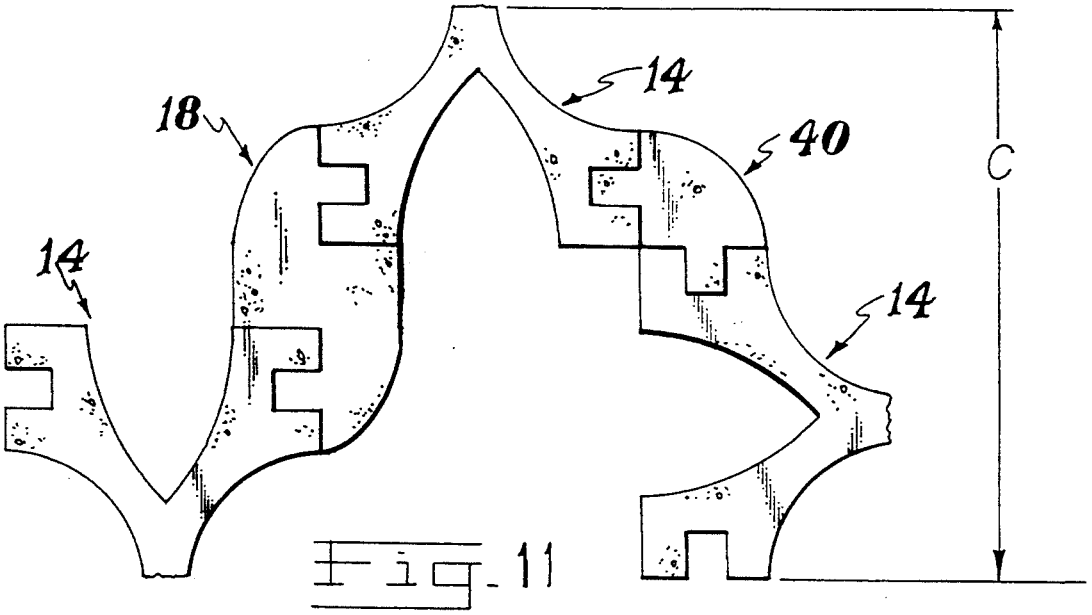
Fig. 11

NON-RECTANGULAR BLOCK AND WALL

FIELD OF THE INVENTION

The blocks of this invention are new and novel blocks which when used to construct walls, give the builder added advantages that one cannot gain by the use of standard blocks for the same purpose.

It is desirable when building walls for sound dampening or the retention of soil and/or water, or the like, to want the wall to have an aesthetic appearance while at the same time, be easy to construct, be stable against the material that is being retained, and against strong winds, and the like. In some wall applications, it is desirable that the wall itself have a sound dampening capability like, for example, walls that are built along highways and freeways to protect the residents behind them from the sounds of traffic.

Further, it is desirable if such walls can be built that can accommodate surface irregularities in the terrain that they are being built on, and further, it is desirable if the blocks are designed such that they can be used to build serpentine structures and other irregular wall structures. This latter desirability requires that the blocks and their components be designed such that one can build articulating joints, corners, and artistic spacers.

BACKGROUND OF THE INVENTION

There are many catalogs, brochures, and other publications from independent manufacturers of masonry blocks that are available to shown the various styles of blocks that are available for building wall constructions. Such blocks, however, are square and/or rectangular in shape in their outside dimensions, and the decorative parts of the block are usually not the design of the block itself, but are designs that are molded or built into the outer surfaces of the block. These blocks have limited utility when used as wall blocks because there are a limited number of ways in which the blocks can be used. Further, such blocks do not have joints that, in combination with connector blocks, can be articulated to give circular walls, or serpentine wall constructions, nor do they have the other advantages of the blocks of the instant invention, which advantages will be set forth in this specification infra.

Other blocks that have been disclosed for use in building masonry walls, generally in buildings, take the form of, for example, the interlocking cement block provided by the disclosure of A. J. Cilento, et al, in U.S. Pat. No. 2,185,497, issued on Jan. 2, 1940 in which there is shown an interlocking brick building product.

Aside from the prior art provided by the Cilento et. al. disclosure, the applicants herein are aware of several other building blocks which are standard and comprise the prior art, some of which are available commercially.

For example, in U.S. Pat. No. 1,234,990, issued Jul. 31, 1917 to W. E. Wilson, there is disclosed a wall construction using hollow building blocks having an interiorly webbed construction that will allow them to cooperate when in a wall or other structure to afford horizontal air passages, while the vertical webs or walls lend support to any wall constructed therefrom.

A second disclosure can be found in U.S. Pat. No. 1,700,542, which issued Jan. 29, 1929 to J. A. O'Donnell in which there is shown a building tile having a fluted surface which allows for the inclusion of cement or mortar when the blocks are used for building a wall.

Other blocks include those disclosed by Iannarelli, in U.S. Pat. No. 4,631,885, issued Dec. 30, 1986; Salazar in U.S. Pat. No. 4,590,726, issued May 27, 1986; Rubenstein, in U.S. Pat. No. 2,951,001, issued Aug. 30, 1960; Johnson, in U.S. Pat. No. 245,340, issued Aug. 9, 1977; Seat, in U.S. Pat. No. 1,458,551, issued Jun. 12, 1923; Dula, in U.S. Pat. No. 1,411,005, issued Mar. 28, 1922; Colt, in U.S. Pat. No. 1,262,308, issued Apr. 9, 1918; Tsanoff, in U.S. Pat. No. 1,338,468, issued Apr. 27, 1920; Podmore, in U.S. Pat. No. 772,476, issued Oct. 18, 1904, and Veyon, in U.S. Pat. No. 776,441, issued Nov. 29, 1904.

Also, there is disclosed in U.S. Pat. No. 4,335,549, which issued on Jun. 22, 1982 to Robert W. Dean, a composite module, which is a building block which can be severed after it is manufactured, to be used for constructing a decorative exterior finished wall structure. This block can only be severed by a machine, and is not adaptable to on-the-job severing by a hand chisel and the like. Also, this building block does not seem to have the capacity for fulfilling the needs that the blocks of the instant invention have.

Thus, none of the art known to the inventors is believed to anticipate or make obvious the building blocks of the instant invention or their use to build wall structures that are retaining, decorative, open, walls, that give the maximum amount of lineal feet versus square feet coverage. Further, the blocks of this invention can be stacked vertically without the use of mortar, provide excellent sound barrier capabilities, allow for construction on irregular terrain, provide good "shadow", beauty, flexible pattern change, and articulative joints, and provide a center of gravity such that the walls do not lean or tumble down, yet still provide an open architecture which will allow air flow in, around, and through the wall, yet limit vision past the wall to provide privacy, and, still provide an overall aesthetic appearance.

BRIEF DESCRIPTION OF THE DRAWINGS

FIG. 9 is a top view of a connector block of this invention.

FIG. 9A is a front view of the block of FIG. 9.

FIG. 10 is a top view of a corner block of this invention.

FIG. 10A is a front view of the block of FIG. 10.

FIG. 11 is a wall or fence showing the use of blocks of this invention in combination.

THE INVENTION

The instant invention deals with novel building blocks that are useful for constructing wall structures.

Specifically, the instant invention deals, in part, with a building block, wherein the building block has a cross axis, a core axis, and a short axis. The block also provides a back surface, a front surface, two essentially identical side walls, and two essentially identical end surfaces parallel to each other.

The block has a large center core through it which is essentially aligned with and parallel to the core axis of the block. The side walls are parallel to each other and flat along a plane parallel to the plane provided by the cross axis and the core axis. The back surface is essentially flat and perpendicular to the plane provided by the cross axis and the core axis and the back surface is essentially a flat, rectangular configuration. The front surface has three integral segments which comprise a raised center segment, and two lateral segments. Each side wall has located therein a channel of predetermined width and depth, each said channel being aligned with and parallel to the core axis of the block, the length of each said channel being equal to the length of the core axis of the block.

DETAILED DESCRIPTION OF THE DRAWINGS FOR A FIRST BLOCK OF THIS INVENTION

Figure 1:
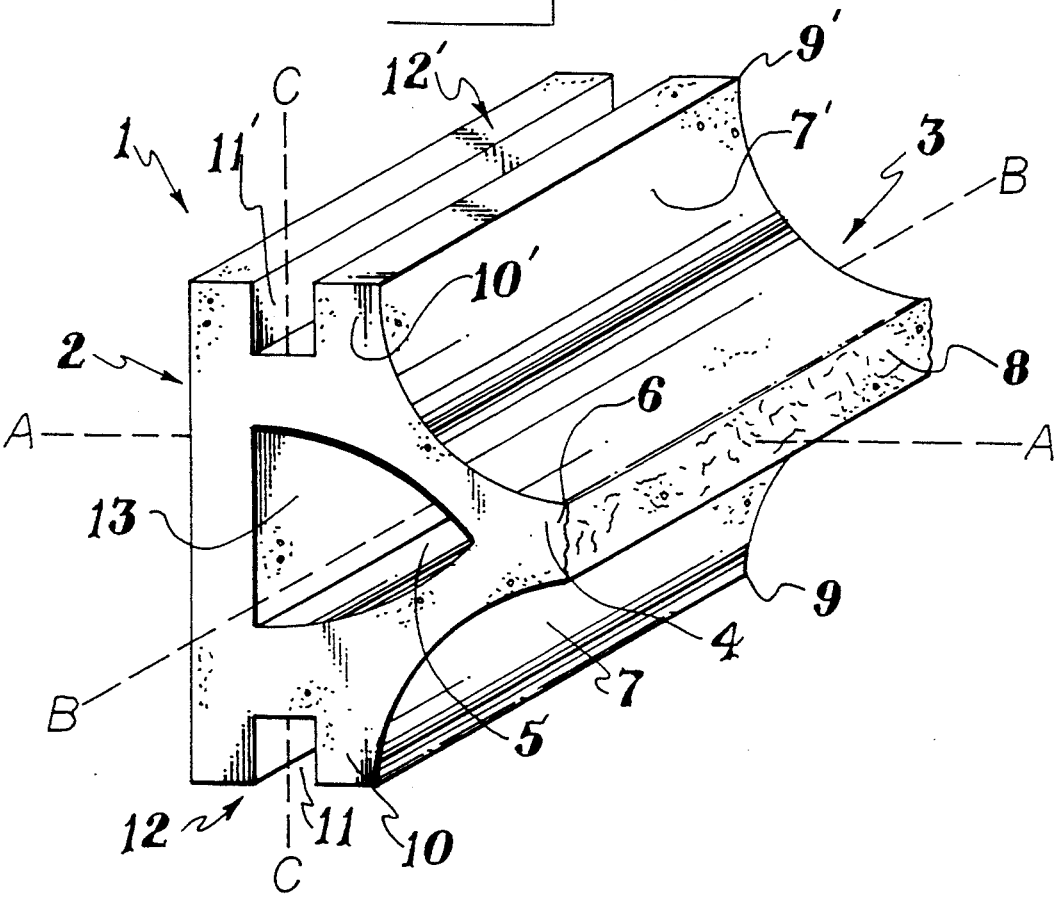
FIG. 1 is an isometric view of one block of this invention.

Thus, with reference to FIG. 1, there is shown one embodiment of this invention, a block 1, in which there is shown a cross axis designated by a line A—A which is located through the center of the block from the back to the front thereof, and a core axis designated by a line B—B which is located through the center of the core of the block from end to end, and a long axis designated by a line C—C which is located through the center of the side walls of the block and runs perpendicular to a plane formed by the A—A and B—B axes. The plane formed by the axes A—A and B—B is considered to lie perpendicular to the plane of the drawing surface of the drawings, and in a horizontal position, for purposes of discussion, it being understood by those skilled in the art that the axes are included at this point for orientation for purposes of discussion of the block and it should be noted by those skilled in the art that the orientation of the block can be had at any point around any of the axes without such blocks actually falling outside the scope of the claims herein.

Figure 12:
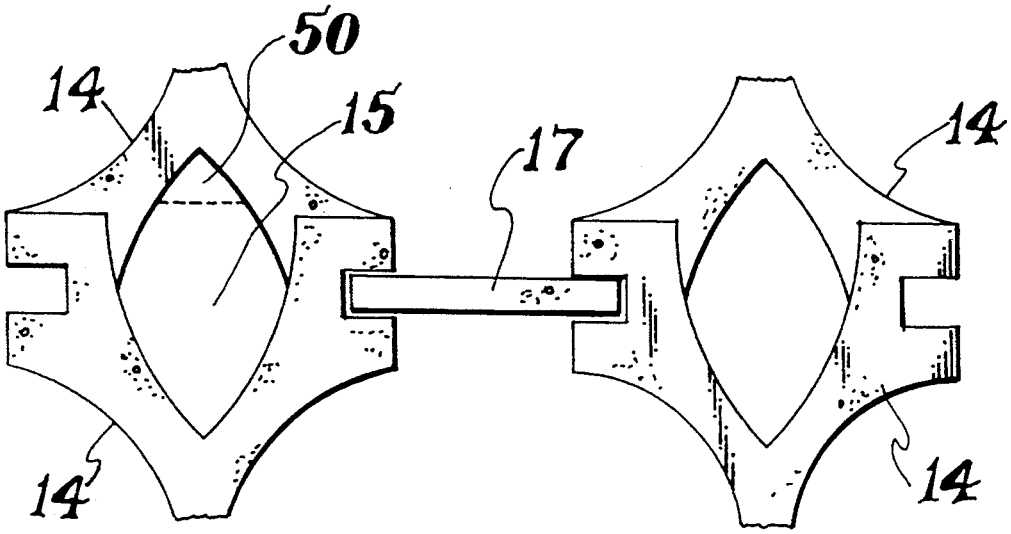
FIG. 12 shows a top view of a vertically stacked gence or wall wherein the blocks are stacked alternately in the opposite direction to create a wall with air hole.
Figure 12A:
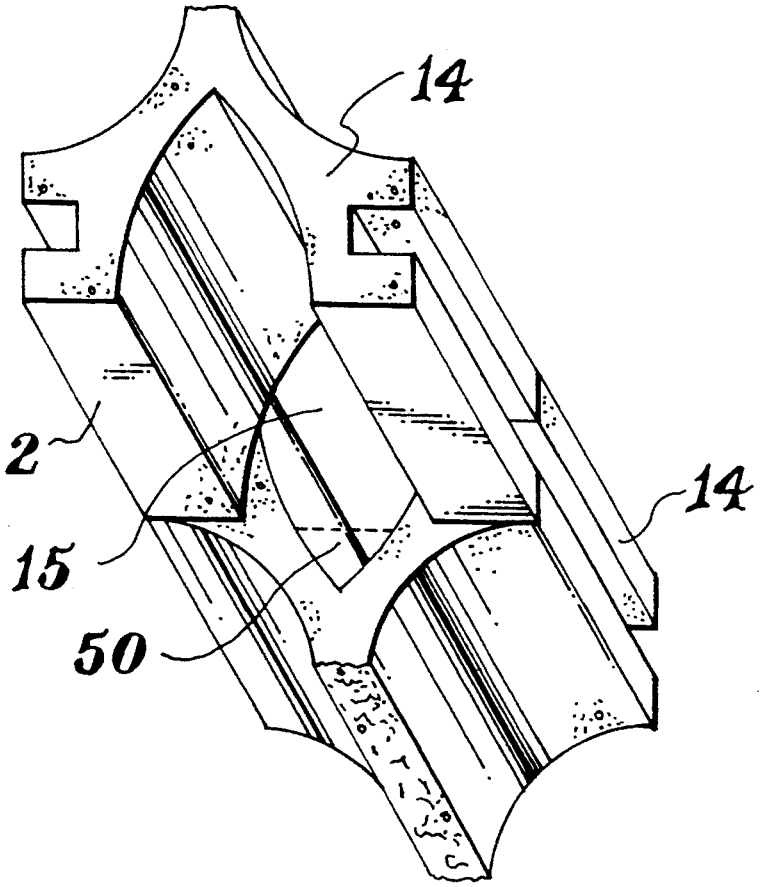
FIG. 12A shows an isometric view of the blocks of FIG. 12 to illustrate the air hole which can be created.

The block 1 has a back surface 2 and a front surface 3, the back surface 2 not being visible in FIG. 1, but is visible in FIG. 12A. The side walls 12 and 12' are parallel to each other and are flat along a plane parallel to the plane formed by axes A—A and B—B.

The back surface 2 is essentially a flat plane and is perpendicular to the plane formed along the axes A—A and B—B of the block and it is essentially a rectangular configuration. The front surface 3 has three integral segments which comprise a raised center segment 6, and two lateral segments 7 and 7'. The front surface is not restricted to the configuration shown in FIG. 1, but can have any configuration which gives the two advantages of weight distribution (which will be discussed infra), and sound absorbing capabilities. By sound absorbing capabilities, the inventors herein mean a combination of the properties of the block surface and the configuration of the block, along with the manner in which the block has been used to construct a wall. The properties of the block surface and the configuration of the block being discussed here, while the manner in which the block has been used to construct a wall for sound absorbing capabilities, will be discussed infra.

Figure 3:
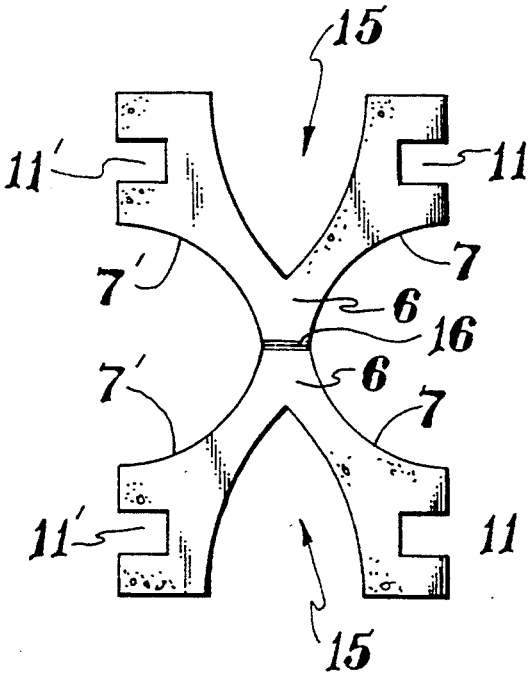
FIG. 3 is a top view of two of the blocks of FIG. 2 wherein they are joined in Siamese fashion at their raised center surfaces.
Figure 4:
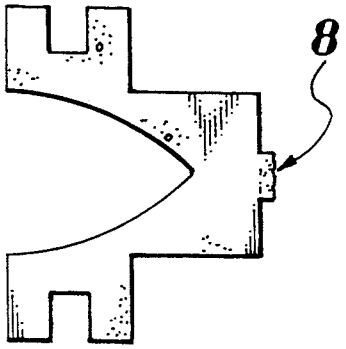
FIGS. 4, 5, 6, and 7, are top views of alternate configurations of the blocks of this invention.
Figure 5:
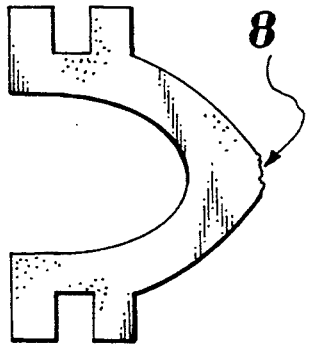
Figure 6:
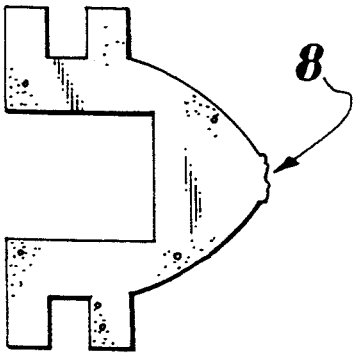
Figure 7:
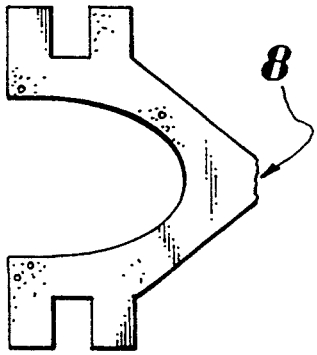

The raised center segment 6 has a front surface 8, which is formed by severing the block from its Siamese twin block of FIG. 3, during the construction of the wall. The discussion of the severability of the Siamese twin blocks will be discussed infra.

After severance, the front surface 8 of the block is irregular in surface conformity and is more porous than the the other parts of the block 1, surrounding such porous surface. This is because, during manufacture of the block, the cement used to manufacture the block is tampped or compressed in a mold in order to shape the block and to increase it's density and it's strength. The mold necessarily provides a smooth surface to the exterior of the block, which makes it slightly more dense than the interior of the block. When a block surface is broken, the less dense surface is exposed. This less dense surface, along with the irregularity of the surface gives some of the sound absorbing properties of the block 1 of the instant invention.

The two lateral segments 7 and 7' are constructed such that they form at their outer edges 9 and 9', retaining walls 10 and 10'. These retaining walls 10 and 10' are required, as they form part of the channels 11 and 11' in the side walls 12 and 12' which are used to hold connector blocks (described infra), and provide an articulation point for the connector blocks (also described infra).

The end surfaces 4 of the block 1 are essentially identical and they are parallel to each other. Only one end surface is visible in FIG. 1, but since the other end is identical in surface configuration, it is not necessary to show the other end surface.

As was indicated supra, channels 11 and 11' are each located in the side walls 12 and 12', respectively, each of said channels 11 and 11' having a length equal to the core axis length of the block 1, and each of said channels 11 and 11' being essentially centered, respectively, in the side walls 12 and 12'. Thus, the channels 11 and 11' are vertically aligned with and parallel to the core axis of the block 1. The width and depth of the channels 11 and 11' are predetermined and molded into the block 1 when it is manufactured. The width and depth in the instant invention being on the average about 2 inches $\times$2 inches for the nominal block size of 8 inches $\times$12 inches $\times$16 inches, the width and depth of the channels 11 and 11' being dependent on the size of the connector blocks being used to assemble the wall.

The block 1 of FIG. 1 has a large center core 5 through it. The core 5 is aligned with and parallel to the core axis B—B of the block. Also, the core 5 is structured to provide at least two advantages. The first advantage is that the overall weight of the block can be reduced by having a large core, but one must balance this weight reduction against any loss of strength of the walls of the block 1. Therefore, the core 5 should be large enough to reduce the overall weight, but yet not be so large such that the walls of the block 1, such as, for example, the back wall 13, are reduced in size, and thus reduce the strength thereof. In a nominal standard size block of 8 inches $\times$12 inches $\times$16 inches, the wall thickness generally will average about two inches in thickness. Reduction of the wall thickness below this limit subjects the walls to reduced strengths.

Figure 2:
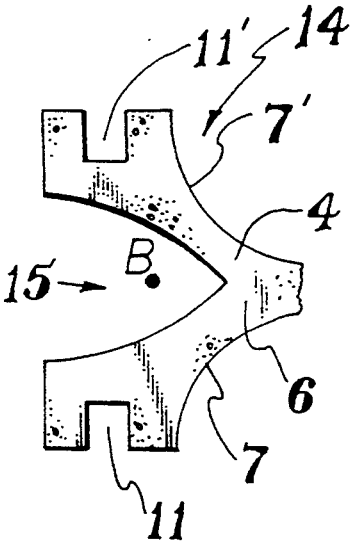
FIG. 2 is an end view of a block of this invention in which the block is open on the back side.

Also contemplated within the scope of this invention is the block 14 shown in FIG. 2. This building block has a cross axis, a core axis, and a long axis and also a back surface, a front surface, two essentially identical side walls, and two essentially identical end surfaces.

The block 14 has a large center opening through it, aligned with and parallel to the core axis of the block.

The side walls are flat along a plane parallel to the plane formed by the axes A—A and B—B.

The back surface is perpendicular to the plane formed by the axes A—A and B—B of the block and has three segments comprised of an open center segment, and two lateral segments.

The open center segment is a continuum of the large center core on through the back surface.

The front surface has three segments, a raised center segment and two lateral segments.

Each of the side walls has located therein a channel of predetermined width and depth, each said channel is aligned with and parallel to the core axis of the block. The length of each said channel is equal to the length of the core axis of the block.

Thus, it should be noted that the there is shown in FIG. 2, an end view of the block 14, and that the back wall 13 is missing. In other words, the block 14 is similar in design to the block 1, but instead of just a core through the center, the entire center is open. This block is the preferred block of this invention because of the fact that it weighs less than most of the other configurations, but still has the advantages set forth herein for the blocks of this invention, including the requisite wall strength.

DETAILED DESCRIPTION OF THE DRAWINGS FOR A SECOND BLOCK OF THIS INVENTION

Thus, in FIG. 2, there is shown an end surface 4, channels 11 and 11', raised center segment 6, two lateral segments 7 and 7', and the open center 15.

As can be noted from the Figures, the blocks of this invention are irregular in shape and because of that fact, it is difficult to manufacture such blocks and handle them sufficiently to be able to ship them to dealers and construction sites. Therefore, this invention also provides for a block which is comprised of two blocks of this invention when joined in Siamese fashion at their raised center surfaces. This configuration, which can be observed in FIG. 3 allows for the molding and manufacturing of the blocks of this invention and also allows such blocks to be cubed in the fashion of the industry for shipment and handling. "Cubed in the fashion of the industry" means that blocks are traditionally transported in cubes wherein the blocks are stacked together, generally in a cube or a rectangle, and strapped down on a wooden or metal pallet and then several of these cubes are transported at the same time. When the blocks are other than a square or rectangle in outside configuration, this mode of transportation cannot be used, and the cost of shipping such irregular blocks is extensive. When taken in the configuration of FIG. 3, it should be noted that the Siamese block presents an outside rectangular or square configuration for the block manufacturers to use during manufacture. Thus, there is very little additional cost associated with the manufacture of the blocks. The Siamese twin block is designed such that the individual blocks can be severed by hand at the connecting point 16 to give each of the blocks 14, an irregular surface 8, as set forth supra.

Shown in FIGS. 4, 5, 6, and 7 are some other configurations that can be used in the blocks of the instant invention without deviating from the claims, it being understood by those in the art that other configurations can be used and that those shown are just for illustrative purposes. Thus, the front surface can be changed in configuration to change the ultimate pattern that the wall will take in appearance after construction.

Figure 8:
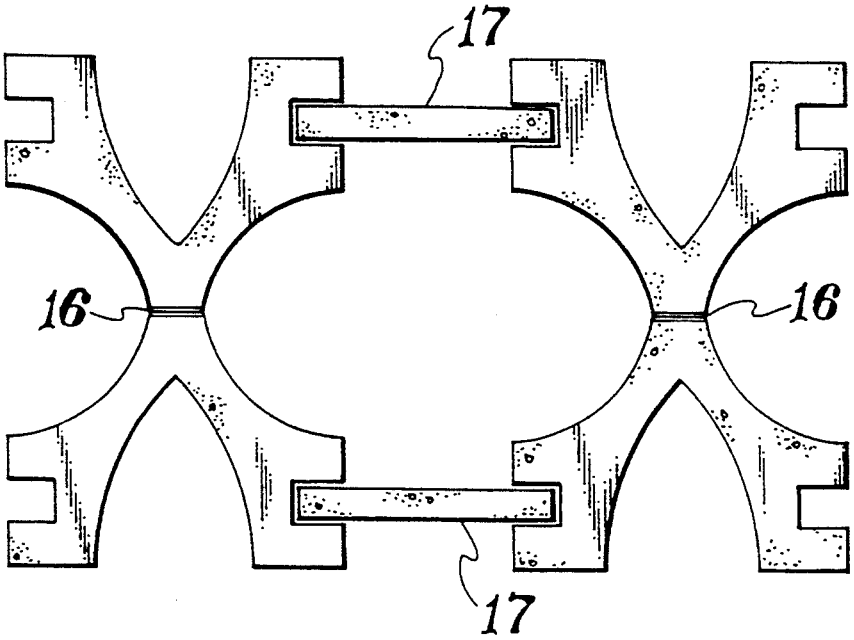
FIG. 8 is a side view of a wall or fence made from the blocks of FIG. 3, using a paver to join them together.

FIG. 8 shows the use of two Siamese blocks of this invention which are unsevered, and which are held in place by flat pavers 17 to give a segment of a wall and illustrate one scheme in which such blocks can be used.

With reference to FIG. 9, there is shown a connecting block 18 which will be referred to herein as a "backbone" block. FIG. 9 is a top view of the block 18, and FIG. 9A is a front view and with regard to both Figures, there is shown a connector block, the connector block having a long axis and a short axis, wherein the long axis bisects the block to create a vertical long axis plane.

The block provides a top surface, a bottom surface, a front surface, a back surface and essentially no end surfaces and the top surface and said bottom surfaces are parallel to each other. The front surface has two segments comprising a post segment and a curved segment, the post segment constituting less than one-half of the surface area of the front surface and the post segment comprising a flat planar surface which essentially coexists with the planar surface of the long axis, and centered therein is a post. The post lays against the flat planar surface and coexists integrally therewith. The post has a length equal to the length of the short axis of the block and the post projects some distance from the flat planar surface.

The curved surface has two elements comprising an end surface and a curved planar surface. The end surface begins at a line which intersects the end surface with the plane of the long axis center plane and extends perpendicular to the long axis center plane to terminate in an outside edge. The width of the end surface is equal to the length of the short axis of the block and the end surface is essentially configured as a rectangular, flat, surface.

The curved planar surface has an outside curvature beginning at the outside edge of the end surface and terminating at a point along the long axis plane distant from the line of intersection of the end surface with the long axis center plane.

The back surface has two segments comprising a post segment and a curved segment, the post segment constituting less than one-half of the surface area of the back surface and the post segment comprises a flat planar surface which essentially coexists integrally with the planar surface of the long axis, and there is centered therein, a post. The post lays against the flat planar surface and coexists integrally with it. The post has a length equal to the length of the short axis of the block and post extends some distance from the flat planar surface.

The curved surface having two elements comprises an end surface and a curved planar surface. The end surface begins at a line which intersects the end surface with the plane of the long axis center plane and extends perpendicular to the long axis center plane to terminate in an outside edge. The width of the end surface is equal to the length of the short axis of the block and the end surface is essentially configured as a rectangular, flat, surface.

The curved planar surface has an outside curvature beginning at the outside edge of the end surface and terminating at a point along the long axis plane distant from the line of intersection of the end surface with the long axis center plane.

DETAILED DESCRIPTION OF THE DRAWINGS FOR A CONNECTOR BLOCK OF THIS INVENTION

Thus, with regard to FIG. 9, which shows a top view of the backbone block 18, and with regard to FIG. 9A, which is a front view of the backbone block 18, there is shown a long axis line designated as A—A, and a short axis line designated as B—B which are used as reference points for the discussion of the backbone block 18.

It will be noted for purposes of illustration only, that the long axis A—A bisects the backbone block 18 to create a vertical long axis plane which is the primary reference point for the discussion of the backbone block 18.

The backbone block 18 has a top surface 19, a bottom surface 20, which is not visible but whose location is indicated in FIG. 9A; a front surface 21, a back surface 22 and there are essentially no end surfaces or side surfaces.

The top and bottom surfaces, 19 and 20, respectively, are parallel to each other and run perpendicular to the long axis plane.

The front surface 21 has two segments comprising a post segment 23 and a curved segment 24 wherein the post segment 23 constitutes less than one-half of the surface area of the front surface 21 and the post segment 23 comprises a flat planar surface 33' which essentially coexists integrally with the planar surface of the long axis, and is centered therein. There is a post 25 which lays against the flat planar surface and coexists integrally therewith. The post 25 has a length equal to the length of the short axis B—B of the backbone block 18 and the post 25 projects some distance from the flat planar surface.

The curved surface 24 also has two elements comprising an end surface 26 and a curved planar surface 27. The end surface 26 begins at a line which intersects the end surface with the flat planar surface of the long axis A—A at point 30 and terminates in an outside edge 28. The width of the end surface 26 is equal to the length of the short axis B—B of the backbone block 18 and thus the end surface 26 has essentially a rectangular, flat, surface.

The curved surface 24 has an outside curvature which is evident from FIG. 9, which begins at the outside edge 28 of the end surface 26 and terminates at a point 29 along the long axis plane some predetermined distance from the line of intersection of the end surface 26 with the long axis A—A center plane.

The back surface 22 has a configuration similar to the front surface 21 and the back surface 22 has two segments comprising a post segment 31 and a curved segment 32. The post segment 31 constitutes less than one-half of the surface area of the back surface 22 and the post segment 31 comprises a flat planar surface 33 which essentially coexists with the planar surface of the long axis A—A.

There is centered in the flat planar surface 33, a post 34. The post 34 lays against the flat planar surface 33 and coexists integrally therewith. The post 34 has a length equal to the length of the short axis B—B of the backbone clock 18 and the post 34 projects some distance from the flat planar surface 33.

The curved segment 32 of the back surface 22 has two elements comprising an end surface 35 and a curved planar surface 36. The end surface 35 begins at a line 37 which intersects the end surface 35 with the plane of the long axis A—A center plane and extends perpendicular to the long axis A—A center plane to terminate in an outside edge 38. The width of the end surface 35 is equal to the length of the short axis B—B of the backbone block 18 and the end surface 35 is essentially configured as a rectangular, flat, surface.

The curved planar surface 36 has an outside curvature as can be observed by reference to FIG. 9, which begins at the outside edge 38 of the end surface 35, and terminates at a point 39 along the long axis plane, some predetermined distance from the line of intersection of the end surface 35 with the long axis center plane.

The configuration thus just described allows the backbone block 18 to be used as an articulating connector block in conjunction with the other blocks of this invention, to give the wall structures disclosed and claimed herein.

DETAILED DESCRIPTION OF THE DRAWINGS FOR A SECOND CONNECTOR BLOCK OF THIS INVENTION

Yet another connector block of this invention, designated herein as the "elbow block" 40, is shown in FIGS. 10 and 10A, the FIG. 10 being a top view of the elbow block 40, and the FIG. 10A being a front view of the elbow block 40.

With regard to FIGS. 10 and 10A, there is shown a block 40 having a first side 41, a second side 42, a third side 43, a top surface 44 and a bottom surface 45. The elbow block 40 also has a short axis B—B from which reference is made for purposes of discussion of this block.

The top surface 44 and the bottom surface 45 are parallel to each other, and their plane surfaces are perpendicular to the short axis B—B of the elbow block 40.

The first side 41 and the second side 42 are essentially identical in configuration and each comprises a flat, planar, rectangular surface 46 and 46' respectively, with the short edges 47, 47', and 48 of the rectangular surface 46 and being parallel to, and equal in length to, the short axis B—B of the block 40.

The short edge 48 is formed by two of the short edges of the flat, planar, rectangular surfaces 46 and 46' intersecting at right angles to each other.

Also, each of the flat, planar rectangular surfaces 46 and 46' have centered in their surfaces, a post 49 and 49', respectively. Each of the posts 49 and 49' lay against the flat planar surface 46 and 46', respectively, and coexist integrally with them. The posts 49 and 49' each have a length equal to the length of the short axis B—B of the elbow block 40 and the posts 49 and 49' each project some distance from the flat planar surfaces 46 and 46', respectively.

The third side 43, has a curved planer surface having an outside curveture beginning at the outside short edge 47 of side 41 and intersecting with and terminating at, the outside short edge 47 of the side 42. Thus, with this configuration, this block allows the construction of a wall which has neat and aesthetic corners, which give stability to the wall.

With reference to FIG. 11, there is shown therein, a top view of a wall in which the blocks 1 are connected together with the connector block 18 and the connector block 40 to show one use of the blocks in combination and how the blocks go together with each other. It should be noted that the stability of the wall is enhanced against strong winds because of the fact that the wall can be constructed as shown in FIG. 11 wherein the distance in width of the wall as indicated by the line C, is twice the width of normal walls. This width gives the wall stability even against the strongest winds, on the order of hurricane strength, and thus, this wall structure is useful in those climates having such weather.

With reference to FIG. 12, which is a top view of a wall, and FIG. 12A, which is an isometric view of two of the blocks 14, vertically stacked, in opposite directions, to create yet another wall. configuration and another method of using the blocks of this invention. The wall can be constructed such that the blocks 14 are stacked vertically, but every other block in the vertical stack can be stacked in the opposite direction, so as to end up with a thick wall, having air flow through it, yet maintaining the center of gravity of the wall at its center, so that the wall is stable and will not lean nor tumble down. This feature of the blocks of this invention allows privacy walls to be constructed which cut the sight of individuals into the walled-in private area of a residence, for example, but which allows air to freely flow through the walls. This configuration also gives a nice aesthetic appeal, as it gives beauty, good shadow, is stable, and is adaptable to all types of terrain. Because the openings 15 overlap with each other, and because the openings do not have a back wall 13, there is created an air hole 50, which is never covered by any portion of a block, and into which the air moves. Since such an opening is created on each side of the wall, there is created a natural passage for the flow of air through the wall, without having to open up the wall to sight from outside the wall.

Figure 12B:
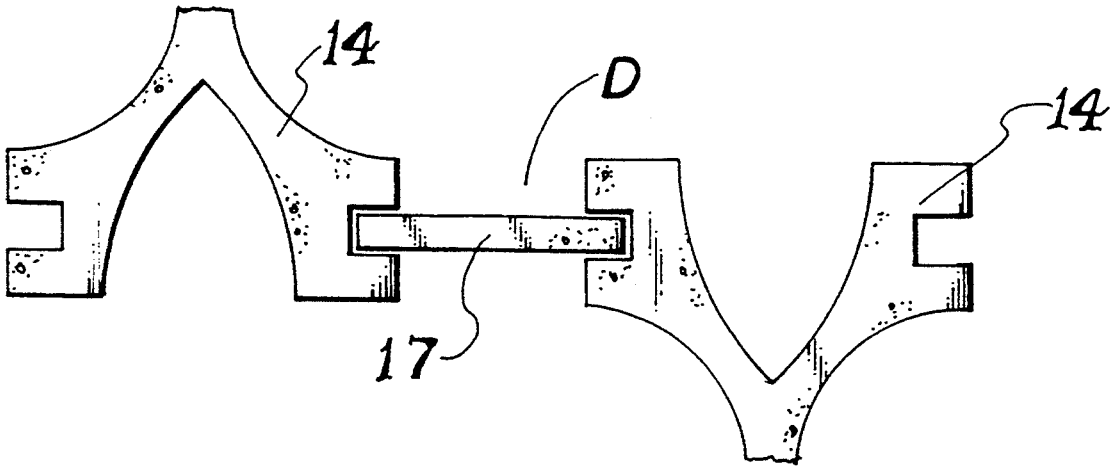
FIG. 12B shows a top view of a fence or wall with opposite block construction.

Finally, there is shown in FIG. 12B a top view of another manner in which the walls of this invention can be constructed from the blocks 14. Thus, there is shown blocks 14, connected by a paver block 17, with a gap D between adjacent blocks 14, it being understood that the gap D does not have to be part of the structure, and that the blocks 14 can be abutted together to make a different pattern in the wall.

We claim:

1. A building block, wherein said building block has a cross axis, a core axis, and a long axis;

said block providing a back surface, a front surface, two essentially identical side walls, and two essentially identical end surfaces, a center from back to front of the block, a center from one end surface to the other end surface of the block, and a center from one side wall to the other side wall of the block;

said cross axis located through the center of the building block from back to front;

said core axis being located through the center of the building block from one end surface to the other end surface;

said long axis being located through the center of one side wall of the block to the other side wall of the block, and perpendicular to a plane formed by the cross axis and the core axis;

said block having a large center opening therethrough aligned with and parallel to the core axis of the block;

said back surface being perpendicular to a plane formed by the cross axis and the core axis and having three segments comprised of an open center segment, and two lateral segments;

said open center segment being a continuum of the large center opening through the back surface;

said front surface having three segments, a raised center segment having a less dense surface than the interior of the block and two lateral segments;

each said side wall having located essentially centered therein from front to back, a channel of predetermined width and depth, each said channel being aligned with and parallel to the core axis of the block, the length of each said channel being equal to the length of the back surface of the block.

2. A wall constructed in whole or in part from building blocks, wherein each building block has a cross axis, a core axis, and a long axis;

said building block providing a back surface, a front surface, two essentially identical side walls, and two essentially identical end surfaces, a center from back to front of the block, a center from one end surface to the other end surface of the block, and a center from one side wall to the other side wall of the block;

said cross axis located through the center of the building block from back to front;

said core axis being located through the center of the building block from one end surface to the other end surface;

said long axis being located through the center of one side wall of the block to the other side wall of the block, and perpendicular to a plane formed by the cross axis and the core axis;

said block having a large center opening therethrough aligned with and parallel to the core axis of the block;

said back surface being perpendicular to a plane formed by the cross axis and the core axis and having three segments comprised of an open center segment, and two lateral segments;

said open center segment being a continuum of the large center opening through the back surface;

said front surface having three segments, a raised center segment having a less dense surface than the interior of the block and two lateral segments;

each said side wall having located essentially centered therein from front to back, a channel of predetermined width and depth, each said channel being aligned with and parallel to the core axis of the block, the length of each said channel being equal to the length of the back surface of the block.

* * * * *